US009677766B2

(12) United States Patent
Abd El-Nabi et al.

(10) Patent No.: US 9,677,766 B2
(45) Date of Patent: Jun. 13, 2017

(54) FUEL NOZZLE FOR USE IN A TURBINE ENGINE AND METHOD OF ASSEMBLY

(71) Applicant: General Electric Company, Schenectady, NY (US)

(72) Inventors: Bassam Sabry Mohammad Abd El-Nabi, Guilderland, NY (US); Gregory Allen Boardman, Greer, SC (US)

(73) Assignee: GENERAL ELECTRIC COMPANY, Niskayuna, NY (US)

( * ) Notice: Subject to any disclaimer, the term of this patent is extended or adjusted under 35 U.S.C. 154(b) by 502 days.

(21) Appl. No.: 13/687,103

(22) Filed: Nov. 28, 2012

(65) Prior Publication Data

US 2014/0144150 A1 May 29, 2014

(51) Int. Cl.

| | |
|---|---|
| ***F23R 3/28*** | (2006.01) |
| ***F23D 14/64*** | (2006.01) |
| ***F23D 14/62*** | (2006.01) |

(52) U.S. Cl.

CPC ..... *F23R 3/286* (2013.01); *F23D 14/64* (2013.01); *F23D 14/62* (2013.01)

(58) Field of Classification Search

CPC ..... F23R 3/286; F23D 14/62; F23D 14/64
USPC .... 60/737, 740, 746, 747, 39.37; 239/419.5, 239/423, 424, 424.5
See application file for complete search history.

(56) References Cited

U.S. PATENT DOCUMENTS 2,526,410 A * 10/1950 Price ..... F02C 6/003 549/250
2,611,244 A * 9/1952 Clarke ..... F23R 3/32 60/736
2,676,461 A * 4/1954 Gove ..... F02C 7/228 137/118.06
2,679,137 A * 5/1954 Probert ..... F02K 3/11 60/39.826
2,701,444 A * 2/1955 Day ..... F23R 3/20 60/39.826

(Continued)

FOREIGN PATENT DOCUMENTS

CN 102252327 A 11/2011
JP 201190785 A 9/2011

OTHER PUBLICATIONS

Zarzalis, Nikolaos, et al., Combustion Stability and Pollutant Formation in Combustion Chambers with Multiple Burner Arrangement, Sonderforschungsbereich 606th Unsteady combustion: Transport Phenomena, Chemical Reaction, Technical Systems Project Z02, 2012, available at http://www.vbt.uni-karlsruhe.de/index.pl/en/Haupt_Menu_Research_M12/proj_steckb/SFB_606_-_Z02, last visited Nov. 28, 2012.

(Continued)

*Primary Examiner* — Pascal M Bui Pho
*Assistant Examiner* — Eric Linderman
(74) *Attorney, Agent, or Firm* — John P. Darling

(57) ABSTRACT

A fuel nozzle for use in a turbine engine is provided. The fuel nozzle includes a fuel injector configured to discharge a flow of fuel therefrom and a premixer tube coupled in flow communication with the fuel injector. The premixer tube is configured to receive the fuel flow and a flow of air at an upstream end of the premixer tube, wherein the fuel and air are progressively mixed as the fuel and air are channeled through the length of the premixer tube.

5 Claims, 5 Drawing Sheets

(56) References Cited

U.S. PATENT DOCUMENTS 2,720,081 A * 10/1955 Tutherly ..... F23R 3/30 60/737
2,920,449 A * 1/1960 Johnson ..... F23D 11/10 60/737
2,930,195 A * 3/1960 Blackman, Jr. ..... F02K 1/822 60/725
3,788,065 A * 1/1974 Markowski ..... F23R 3/34 431/173
3,937,008 A * 2/1976 Markowski ..... F23R 3/04 60/733
3,938,325 A * 2/1976 Bergt ..... F23R 3/00 60/737
3,968,644 A * 7/1976 Fehler ..... F23R 3/02 431/176
3,973,390 A * 8/1976 Jeroszko ..... F23R 3/34 431/10
4,100,733 A * 7/1978 Striebel ..... F23R 3/286 239/419.3
4,455,840 A * 6/1984 Matt ..... F23R 3/10 60/737
5,274,991 A * 1/1994 Fitts ..... 60/800
5,351,477 A * 10/1994 Joshi ..... F23C 7/004 239/400
5,359,847 A * 11/1994 Pillsbury ..... F23D 17/002 60/39.463
5,361,586 A * 11/1994 McWhirter ..... F23D 14/02 60/737
5,511,375 A * 4/1996 Joshi ..... F01D 9/065 239/403
5,613,363 A * 3/1997 Joshi ..... F23C 7/004 239/403
5,771,696 A * 6/1998 Hansel ..... F23R 3/283 60/739
5,822,992 A * 10/1998 Dean ..... F23D 11/104 239/419.3
5,901,555 A * 5/1999 Mandai ..... F23D 23/00 60/39.826
5,930,999 A * 8/1999 Howell ..... F23D 11/107 239/402
6,092,363 A * 7/2000 Ryan ..... F02C 3/20 60/39.463
6,158,223 A * 12/2000 Mandai ..... F23D 23/00 60/737
6,339,923 B1 * 1/2002 Halila ..... F23R 3/286 60/738
6,536,216 B2 * 3/2003 Halila ..... F01D 5/08 60/737
6,688,111 B2 2/2004 Stalder et al.
7,707,833 B1 * 5/2010 Bland ..... F23R 3/286 60/737
7,926,280 B2 * 4/2011 Morenko et al. ..... 60/740
8,007,274 B2 * 8/2011 Johnson et al. ..... 431/40
8,011,187 B2 * 9/2011 Sprouse ..... F23C 13/06 239/499
8,205,452 B2 6/2012 Boardman et al.
8,234,871 B2 * 8/2012 Davis, Jr. ..... F23R 3/286 60/737
8,424,311 B2 * 4/2013 York et al. ..... 60/737
8,550,809 B2 * 10/2013 Uhm et al. ..... 431/8
8,794,545 B2 * 8/2014 Johnson et al. ..... 239/423
8,904,798 B2 * 12/2014 Manoharan et al. ..... 60/737
9,121,612 B2 * 9/2015 Uhm ..... F23R 3/286
2001/0004827 A1 * 6/2001 Vandervort ..... F23R 3/14 60/39.55
2001/0022088 A1 * 9/2001 Mandai ..... F23D 17/002 60/737
2002/0014078 A1 * 2/2002 Mandai ..... F23R 3/286 60/737
2002/0192615 A1 * 12/2002 Moriya ..... F23D 14/02 431/278
2003/0010033 A1 * 1/2003 Mansour ..... F23R 3/286 60/740
2003/0110774 A1 * 6/2003 Saitoh ..... F23D 14/70 60/737
2004/0006990 A1 * 1/2004 Stuttaford ..... F23R 3/286 60/776
2004/0020210 A1 * 2/2004 Tanaka ..... F23R 3/343 60/740
2004/0035114 A1 * 2/2004 Hayashi ..... F23R 3/18 60/737
2004/0045296 A1 * 3/2004 Wiebe ..... F23R 3/286 60/737
2004/0050057 A1 * 3/2004 Bland ..... F23D 14/82 60/737
2004/0060295 A1 * 4/2004 Mandai ..... F23R 3/005 60/725
2004/0060301 A1 * 4/2004 Chen et al. ..... 60/776
2004/0229178 A1 * 11/2004 Mandai ..... F23R 3/14 431/195
2005/0076647 A1 * 4/2005 Farhangi ..... F23C 13/06 60/776
2005/0076648 A1 * 4/2005 Farhangi ..... F23C 9/00 60/776
2005/0106519 A1 * 5/2005 Flohr ..... F23R 3/14 431/114
2005/0188703 A1 * 9/2005 Sprouse ..... F23D 3/40 60/776
2005/0223713 A1 * 10/2005 Ziminsky ..... F23D 14/74 60/776
2005/0268617 A1 * 12/2005 Amond et al. ..... 60/776
2007/0169486 A1 * 7/2007 Hernandez ..... F23R 3/286 60/776
2008/0041060 A1 * 2/2008 Nilsson ..... F23R 3/14 60/737
2008/0115501 A1 * 5/2008 Elkady ..... F23R 3/14 60/776
2008/0173019 A1 * 7/2008 Kobayashi ..... F23R 3/343 60/739
2008/0280238 A1 * 11/2008 Smith ..... F23R 3/14 431/9
2009/0077972 A1 * 3/2009 Singh ..... F02C 7/222 60/737
2009/0188255 A1 * 7/2009 Green et al. ..... 60/737
2009/0223225 A1 * 9/2009 Kraemer et al. ..... 60/723
2009/0277182 A1 * 11/2009 Engelbrecht ..... F23D 11/36 60/772
2009/0293482 A1 * 12/2009 Davis, Jr. ..... F23D 14/82 60/737
2010/0031662 A1 * 2/2010 Zuo ..... 60/740
2010/0071373 A1 * 3/2010 Martin ..... F23R 3/14 60/734
2010/0084490 A1 * 4/2010 Zuo et al. ..... 239/132.3
2010/0095676 A1 4/2010 Uhm et al.
2010/0192579 A1 * 8/2010 Boardman ..... F23R 3/12 60/737
2010/0192581 A1 * 8/2010 Ziminsky et al. ..... 60/737
2010/0236247 A1 * 9/2010 Davis, Jr. ..... F23R 3/286 60/742
2010/0248173 A1 9/2010 Ehara et al.
2010/0252652 A1 * 10/2010 Johnson ..... F23D 14/62 239/132
2011/0016866 A1 * 1/2011 Boardman ..... F23R 3/28 60/730
2011/0016871 A1 * 1/2011 Kraemer et al. ..... 60/772
2011/0057056 A1 * 3/2011 Ziminsky et al. ..... 239/398
2011/0061395 A1 * 3/2011 Kendrick ..... F02C 7/22 60/772
2011/0083439 A1 * 4/2011 Zuo et al. ..... 60/737
2011/0113783 A1 * 5/2011 Boardman ..... F23C 13/06 60/723
2011/0185703 A1 8/2011 Dodo et al.
2011/0197587 A1 * 8/2011 Zuo et al. ..... 60/740
2011/0197594 A1 8/2011 Khosla et al.
2011/0203284 A1 * 8/2011 Ritland ..... F23R 3/286 60/739
2011/0239652 A1 * 10/2011 McMahan ..... F23R 3/34 60/737

(56) References Cited

U.S. PATENT DOCUMENTS

2011/0239653 A1* 10/2011 Valeev ..... F23R 3/34 60/740
2012/0060511 A1* 3/2012 Zuo et al. ..... 60/806
2012/0111016 A1* 5/2012 Lockyer ..... F02C 7/222 60/772
2012/0131923 A1* 5/2012 ELKady ..... F23R 3/14 60/772
2012/0131924 A1* 5/2012 Yoshida ..... F23R 3/343 60/772
2012/0180487 A1* 7/2012 Uhm et al. ..... 60/737
2012/0198856 A1 8/2012 Uhm et al.
2012/0227407 A1* 9/2012 Reiss ..... F23R 3/286 60/737
2013/0025284 A1* 1/2013 Wu ..... F23R 3/14 60/737
2013/0084534 A1* 4/2013 Melton ..... F23R 3/10 431/2
2013/0122434 A1* 5/2013 Stoia ..... F23R 3/286 431/12
2013/0122435 A1* 5/2013 Stoia ..... F23R 3/286 431/12
2013/0122436 A1* 5/2013 Stoia ..... F23R 3/286 431/12
2013/0122437 A1* 5/2013 Melton ..... F23R 3/286 431/12
2013/0199190 A1* 8/2013 Uhm ..... F23R 3/286 60/740
2013/0213051 A1* 8/2013 Westmoreland, III .. F23R 3/286 60/775
2013/0232979 A1* 9/2013 Singh ..... F23R 3/286 60/737
2014/0144142 A1* 5/2014 Abd El-Nabi ..... F23R 3/32 60/737
2014/0216041 A1* 8/2014 Ostebee ..... F02C 7/22 60/737

OTHER PUBLICATIONS

Beer, Janos M., Low NOx Burners for Boilers, Furnaces and Gas Turbines; Drive Towards the Lower Bounds of NOx Emissions, Combustion Science and Technology, 1996, pp. 169-191, vol. 121, Issue 1-6.

Papagiannakis, R.G. et al., Combustion and Exhaust Emission Characteristics of a Dual Fuel Compression Ignition Engine Operated with Pilot Diesel Fuel and Natural Gas, Energy Conversion and Management, Nov. 2004, pp. 2971-2987, vol. 45, Issue 18-19.

Weber, Roman et al., On the (MILD) Combustion of Gaseous , Liquid, and Solid Fuels in High Temperature, Jan. 2005, pp. 2623-2629, vol. 30, Issue 2.

* cited by examiner

FUEL NOZZLE FOR USE IN A TURBINE ENGINE AND METHOD OF ASSEMBLY

BACKGROUND OF THE INVENTION

The field of the present disclosure relates generally to turbine engines and, more specifically, to a fuel nozzle for use in a turbine engine.

Rotary machines, such as gas turbines, are often used to generate power for electric generators. Gas turbines, for example, have a gas path which typically includes, in serial-flow relationship, an air intake, a compressor, a combustor, a turbine, and a gas outlet. Compressor and turbine sections include at least one row of circumferentially-spaced rotating buckets or blades coupled within a housing. At least some known turbine engines are used in cogeneration facilities and power plants. Such engines may have high specific work and power per unit mass flow requirements. To increase operating efficiency, at least some known gas turbine engines may operate at increased combustion temperatures.

While operating known turbine engines at higher temperatures increases operating efficiency, it may also increase the generation of polluting emissions, such as oxides of nitrogen ($NO_X$). Such emissions are generally undesirable and may be harmful to the environment. To facilitate reducing NOx emissions, at least some known gas turbine plants use selective catalytic reduction (SCR) systems. Known SCR systems convert NOx, with the aid of a catalyst, into elemental nitrogen and water. However, SCR systems increase the overall costs associated with turbine operation. Furthermore, at least some known gas turbine plants inject water into the fuel/air mixture prior to combustion to facilitate reducing combustion temperature. However, the presence of water in the turbine engine may result in damage to engine components such as turbine blades and the combustion liner.

At least some known fuel injection assemblies attempt to reduce NOx emissions by using pre-mixing technology. In such assemblies, a portion of fuel and air is mixed upstream from the combustor to produce a lean mixture. Pre-mixing the fuel and air facilitates controlling the temperature of the combustion gases such that the temperature does not rise above a threshold where NOx emissions are formed. Some known fuel injection assemblies include at least one set of vanes that are used to swirl fuel and air prior to use in a combustor. Such known assemblies are known as swirl stabilized combustors.

BRIEF DESCRIPTION OF THE INVENTION

In one aspect, a fuel nozzle for use in a turbine engine is provided. The fuel nozzle includes a fuel injector configured to discharge a flow of fuel therefrom and a premixer tube coupled in flow communication with the fuel injector. The premixer tube is configured to receive the fuel flow and a flow of air at an upstream end of the premixer tube, wherein the fuel and air are progressively mixed as the fuel and air are channeled through the length of the premixer tube.

In another aspect, a fuel nozzle for use in a turbine engine is provided. The fuel nozzle includes a nozzle body, a fuel injector configured to discharge a flow of fuel therefrom, and a premixer tube extending through said nozzle body. The premixer tube is coupled in flow communication with the fuel injector and configured to receive the fuel flow and a flow of air at an upstream end of the premixer tube, wherein the fuel and air are progressively mixed as the fuel and air are channeled through the length of the premixer tube.

In yet another aspect, a method of assembling a fuel nozzle for use in a turbine engine is provided. The method includes configuring a fuel injector to discharge a flow of fuel therefrom and coupling a premixer tube in flow communication with the fuel injector such that the premixer tube receives the fuel flow and a flow of air at an upstream end of the premixer tube. The fuel and air are progressively mixed as the fuel and air are channeled through the length of the premixer tube.

DETAILED DESCRIPTION OF THE INVENTION

Embodiments of the present disclosure enable the use of liquid fuel in a gas turbine combustor with or without water injection while still achieving low NOx levels. In the exemplary embodiments, the combustor flame is stabilized based on a jet concept and not a swirl concept. More specifically, embodiments of the present disclosure pre-mix fuel and air in a fuel nozzle by pre-vaporizing liquid fuel in a flow of compressed air. Air is channeled from the compressor to the fuel nozzles while fuel injection spokes simultaneously inject liquid fuel into the fuel nozzles. The spokes include small injection ports defined therein such that the fuel injector described herein may be classified as a "plain orifice atomizer". Plain orifice atomizers are known to be a cost efficient injector and are known to have a narrow jet angle, which facilitates minimizing the need to wet the fuel nozzle surfaces. Furthermore, by using a jet concept as opposed to a swirl concept, the likelihood of auto-ignition and/or flashback is facilitated to be reduced. As such, the fuel nozzle described herein facilitates enabling the use of liquid fuel, facilitates reducing NOx emissions, and improves the cost efficiency of a turbine engine.

Figure 1:
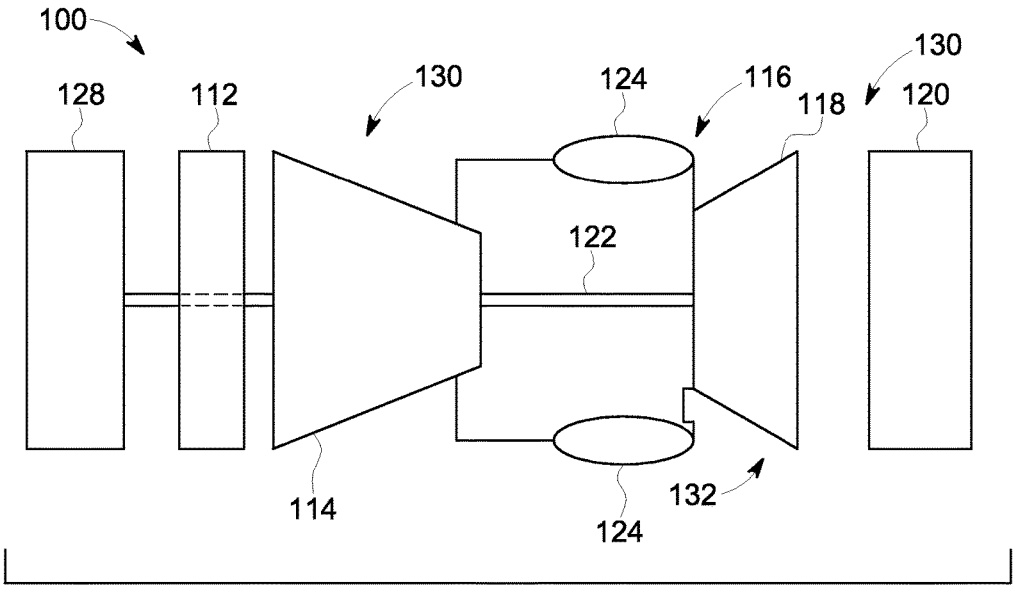
FIG. 1 is a schematic view of an exemplary turbine engine.

FIG. 1 is a schematic view of an exemplary turbine engine 100. More specifically, in the exemplary embodiment turbine engine 100 is a gas turbine engine that includes an intake section 112, a compressor section 114 downstream from intake section 112, a combustor section 116 downstream from compressor section 114, a turbine section 118 downstream from combustor section 116, and an exhaust section 120. Turbine section 118 is coupled to compressor section 114 via a rotor shaft 122. In the exemplary embodiment, combustor section 116 includes a plurality of combustors 124. Combustor section 116 is coupled to compressor section 114 such that each combustor 124 is in flow communication with compressor section 114. Turbine section 118 is coupled to compressor section 114 and to a load 128 such as, but not limited to, an electrical generator and/or a mechanical drive application through rotor shaft 122. In the exemplary embodiment, each of compressor section 114 and turbine section 118 includes at least one rotor disk assembly 130 that is coupled to rotor shaft 122 to form a rotor assembly 132.

During operation, intake section 112 channels air towards compressor section 114 wherein the air is compressed to a higher pressure and temperature prior to being discharged towards combustor section 116. The compressed air is mixed with fuel and then ignited to generate combustion gases that are channeled towards turbine section 118. More specifically, the fuel mixture is ignited to generate high temperature combustion gases that are channeled towards turbine section 118. Turbine section 118 converts the energy from the gas stream to mechanical rotational energy, as the combustion gases impart rotational energy to turbine section 118 and to rotor assembly 132.

Figure 2:
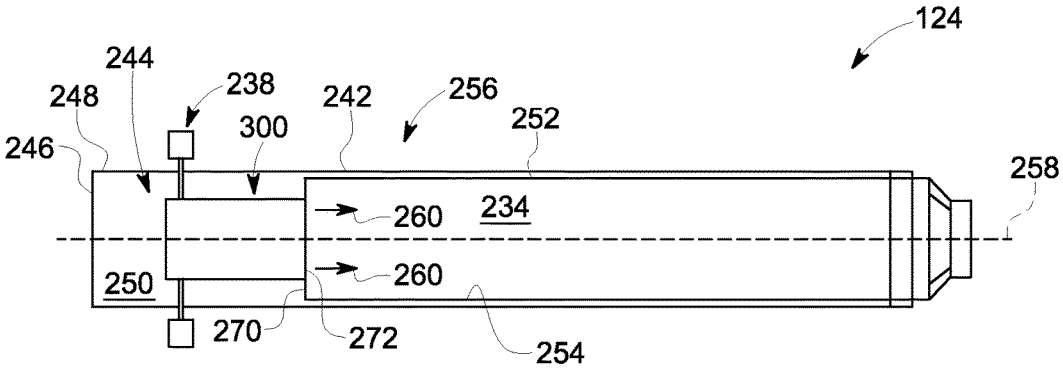
FIG. 2 is a sectional view of an exemplary combustor assembly that may be used with the turbine engine shown in FIG. 1.

FIG. 2 is a sectional view of an exemplary combustor assembly 124. In the exemplary embodiment, combustor assembly 124 includes a casing 242 that defines a chamber 244 within casing 242. An end cover 246 is coupled to an outer portion 248 of casing 242 such that an air plenum 250 is defined within chamber 244. Compressor section 114 (shown in FIG. 1) is coupled in flow communication with chamber 244 to channel compressed air downstream from compressor section 114 to air plenum 250.

In the exemplary embodiment, each combustor assembly 124 includes a combustor liner 252 positioned within chamber 244 and coupled in flow communication with turbine section 118 (shown in FIG. 1) through a transition piece (not shown) and with compressor section 114. Combustor liner 252 includes a substantially cylindrically-shaped inner surface 254 that extends between an aft portion (not shown) and a forward portion 256. Inner surface 254 defines annular combustion chamber 234 extending axially along a centerline axis 258, and extends between the aft portion and forward portion 256. Combustor liner 252 is coupled to a fuel nozzle 300 such that fuel nozzle 300 channels fuel and air into combustion chamber 234. Combustion chamber 234 defines a combustion gas flow path 260 that extends from fuel nozzle 300 to turbine section 118. In the exemplary embodiment, fuel nozzle 300 receives a flow of air from air plenum 250, receives a flow of fuel from a fuel supply system 238, and channels a mixture of fuel/air into combustion chamber 234 for generating combustion gases.

In the exemplary embodiment, an end plate 270 is coupled to forward portion 256 of combustor liner 252 such that end plate 270 at least partially defines combustion chamber 234. End plate 270 includes an opening 272 that extends through end plate 270, and is sized and shaped to receive fuel nozzle 300 therethrough. Fuel nozzle 300 is positioned within opening 272 such that fuel nozzle 300 is coupled in flow communication with combustion chamber 234. Alternatively, fuel nozzle 300 may be coupled to combustor liner 252 such that no end plate is needed.

Figure 3:
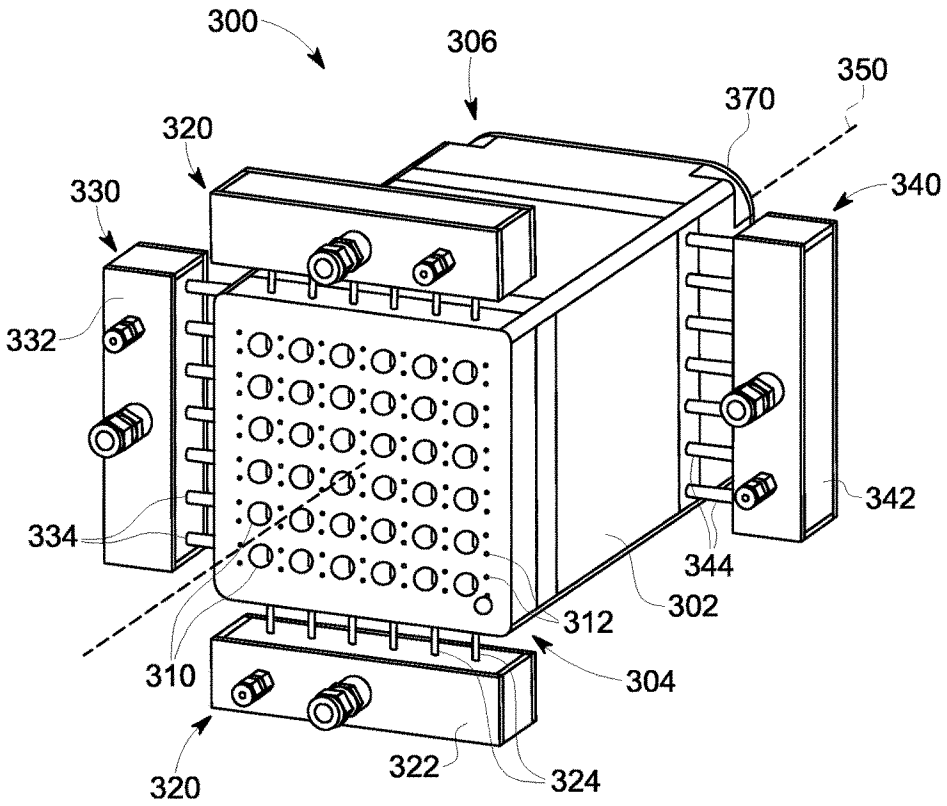
FIG. 3 is a perspective view of an exemplary fuel nozzle that may be used with the combustor assembly shown in FIG. 2.

FIG. 3 is a perspective view of fuel nozzle 300 that may be used with combustor assembly 124. In the exemplary embodiment, fuel nozzle 300 includes a nozzle body 302, a plurality of premixer tubes 310 that are defined within and extend through nozzle body 302, and a plurality of cooling passages 312 that are defined within and extend through nozzle body 302. More specifically, premixer tubes 310 and cooling passages 312 extend from an upstream end 304 of nozzle body 302 to a downstream end 306 of nozzle body 302. As such, premixer tubes 310 and cooling passages 312 couple air plenum 250 in flow communication with combustion zone 234 (shown in FIG. 2). In the exemplary embodiment, premixer tubes 310 and cooling passages 312 extend substantially coaxially through nozzle body 302 with respect to a nozzle centerline axis 350. In an alternative embodiment, at least one premixer tube 310 or at least one cooling passage 312 may be oriented obliquely with respect to nozzle centerline axis 350. Although shown as including thirty six premixer tubes 310, nozzle body 302 may include any suitable number of premixer tubes 310 defined therein that enables fuel nozzle 300 to function as described herein.

In the exemplary embodiment, fuel nozzle 300 also includes a liquid fuel injection assembly 320, a first gas fuel injection assembly 330, and a second gas fuel injection assembly 340 that are each configured to discharge a flow of fuel into premixer tubes 310. Liquid fuel injection assembly 320 includes a liquid fuel source 322 and a plurality of fuel spokes 324 coupled in flow communication with liquid fuel source 322. Gas fuel injection assemblies 330 and 340 each include a gas fuel source 332 and 342, and a plurality of gas fuel tubes 334 and 344 coupled in flow communication with gas fuel sources 332 and 342, respectively. In the exemplary embodiment, fuel injection assemblies 320 and 330 are positioned at upstream end 304 of nozzle body 302, and fuel injection assembly 340 is positioned downstream from assemblies 320 and 330. As such, fuel injection assembly 340 is configured to inject fuel into premixer tubes 310 downstream from assemblies 320 and 330 to facilitate controlling flame instability within combustion zone 234.

Figure 4:
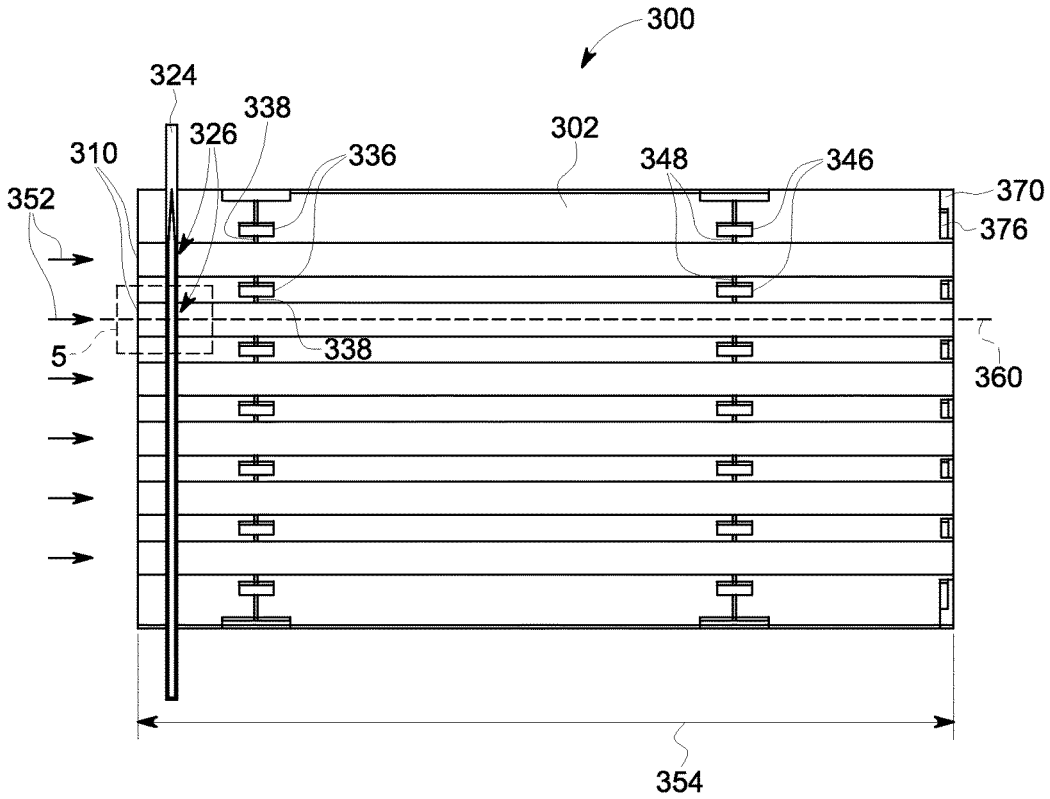
FIG. 4 is a schematic cross-sectional view of the fuel nozzle shown in FIG. 3.
Figure 5:
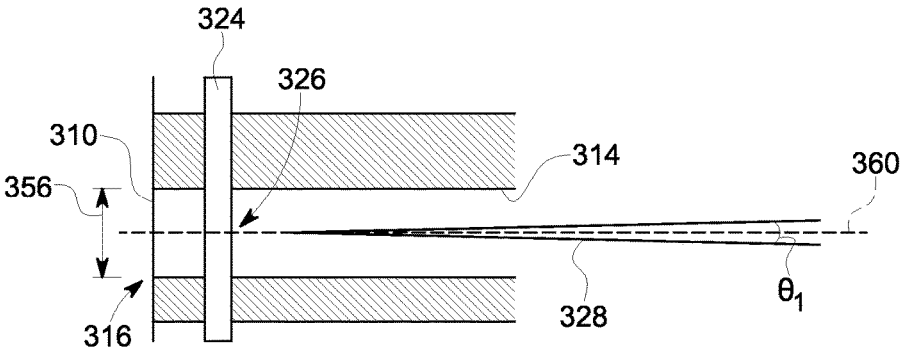
FIG. 5 is an enlarged schematic cross-sectional view of the fuel nozzle shown in FIG. 4 and taken along Area 5.

FIG. 4 is a schematic cross-sectional view of fuel nozzle 300, and FIG. 5 is an enlarged schematic cross-sectional view of fuel nozzle 300 taken along Area 5 (shown in FIG. 4). In the exemplary embodiments, fuel spoke 324 extends through nozzle body 302 and through each premixer tube 310 substantially perpendicularly with respect to a premixer tube centerline axis 360. Fuel spoke 324 includes fuel injection ports 326 defined therein that are configured to discharge a flow of liquid fuel therefrom. More specifically, fuel injection ports 326 are defined within fuel spoke 324 such that liquid fuel jets 328 are directed substantially axially into premixer tubes 310. For example, in one embodiment, injection ports 326 are configured to substantially coaxially align with premixer tube centerline axis 360.

In the exemplary embodiment, fuel injection ports 326 are configured to atomize the liquid fuel directed therefrom such that fuel injection ports 326 may be classified as a "plain orifice atomizer". More specifically, fuel injection ports 326 are configured to discharge liquid fuel jets 328 therefrom at a discharge angle $\Theta_1$ of from about 5° to about 15° with respect to premixer tube centerline axis 360. As such, discharge angle $\Theta_1$ of liquid fuel jet 328 enables liquid fuel to substantially avoid contact with an inner wall 314 of premixer tubes 310 to facilitate preventing coking of premixer tube 310. In an alternative embodiment, fuel spoke 324 may include any suitable fuel injection port 326 that enables fuel nozzle 300 to function as described herein.

As described above, gas fuel injection assemblies 330 and 340 are configured to discharge a flow of fuel into premixer tubes 310. More specifically, nozzle body 302 includes first gas fuel passages 336 and second gas fuel passages 346 that are coupled in flow communication with gas fuel sources 332 and 342 (shown in FIG. 3), and that extend substantially perpendicularly through nozzle body 302 with respect to centerline axis 350 (shown in FIG. 3). In the exemplary embodiment, nozzle body 302 includes gas fuel injection ports 338 and 348 defined therein that are configured to couple gas fuel passages 336 and 346 in flow communication with premixer tubes 310. As such, gas fuel injection ports 338 and 348 are configured to channel gas fuel from gas fuel sources 332 and 342 into premixer tubes 310.

In the exemplary embodiment, air plenum 250 (shown in FIG. 2) is configured to channel a flow of air 352 into premixer tubes 310. As such, premixer tubes 310 receive liquid fuel and/or gas fuel and air 352 at an upstream end 316 of premixer tubes 310. Air plenum 250 is configured to direct air flow 352 into premixer tubes 310 substantially axially with respect to centerline axis 360. As such, the fuel and air are progressively mixed as the fuel and air are channeled through a length 354 of premixer tubes 310. In the exemplary embodiment, premixer tube length 354 is optimized such that a substantially uniform fuel-air mixture is discharged from premixer tubes 310 into combustion zone 234 (shown in FIG. 2). For example, if premixer tubes 310 have a predetermined length and it is found that liquid fuel droplets are being discharged into combustion zone 234, the predetermined length may be increased to facilitate providing the residence time that may be required to vaporize the liquid fuel.

In one embodiment, premixer tubes 310 have a diameter 356 of from about 0.25 inch (0.64 cm) to about 0.75 inch (1.9 cm), and length 354 of from about 9.0 inches (22.9 cm) to about 12.0 inches (30.5 cm). Accordingly, premixer tubes 310 have a length-to-diameter ratio of greater than about 10 to 1. Furthermore, premixer tubes 310 are sized and spaced to facilitate increasing the turndown ratio of fuel nozzle 300. The turndown ratio is the ratio of the flow rate of fuel flowing through fuel nozzle 300 at maximum load compared to the flow rate of the fuel at minimum load. By using premixer tubes 310 having a space to diameter 356 ratio that is from about 1 to about 6, the turndown capabilities of fuel nozzle 300 are extended. In the exemplary embodiment, the space is the distance between the centerlines of adjacent fuel jets 328.

In one embodiment, air plenum 250 is configured to direct air 352 into premixer tubes 310 at a velocity sufficient to disperse the atomized liquid fuel discharged from fuel injection ports 326. Furthermore, air 352 is directed into premixer tubes 310 at a velocity that facilitates preventing flashback and auto-ignition within premixer tubes 310. As such, in one embodiment, air plenum 250 directs air 352 into premixer tubes 310 at a velocity of greater than about 120 feet/second. In the exemplary embodiment, air plenum 250 also directs air 352 at a temperature that is sufficient to vaporize the liquid fuel discharged from fuel injection ports 326. For example, air plenum 250 directs air 352 that has a temperature of from about 500° F. to about 1100° F.

Figure 6:
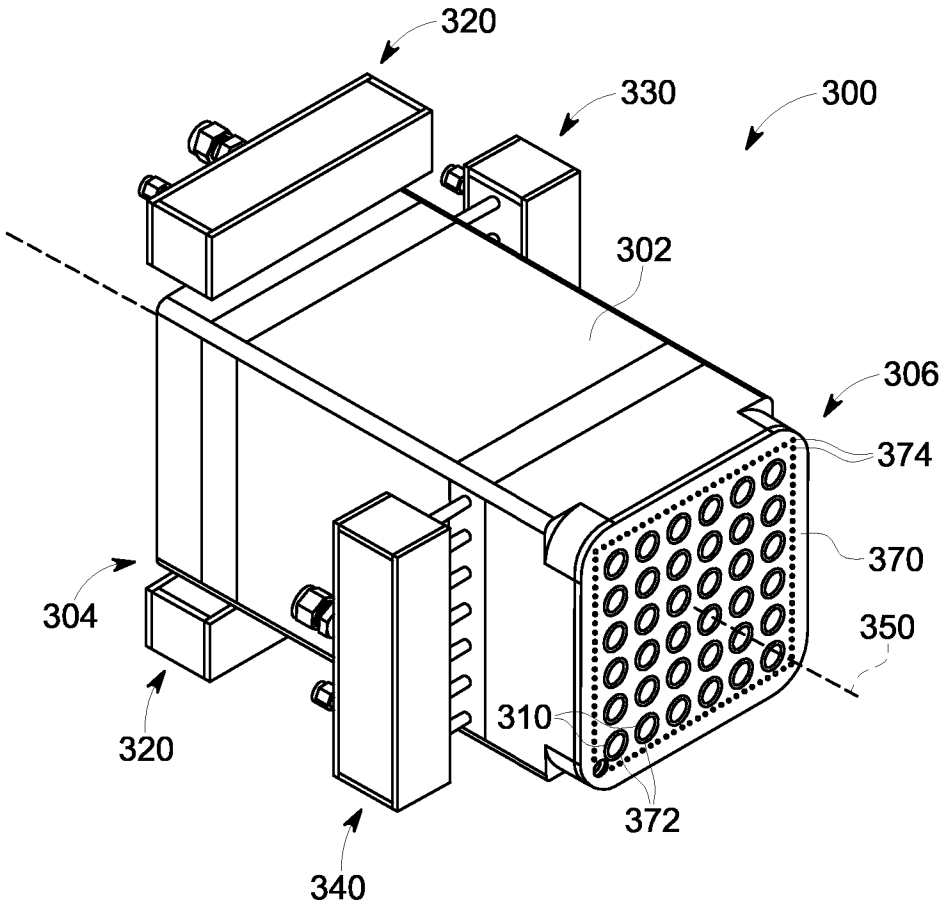
FIG. 6 is an alternative perspective view of the fuel nozzle that may be used with the combustor assembly shown in FIG. 2.
Figure 7:
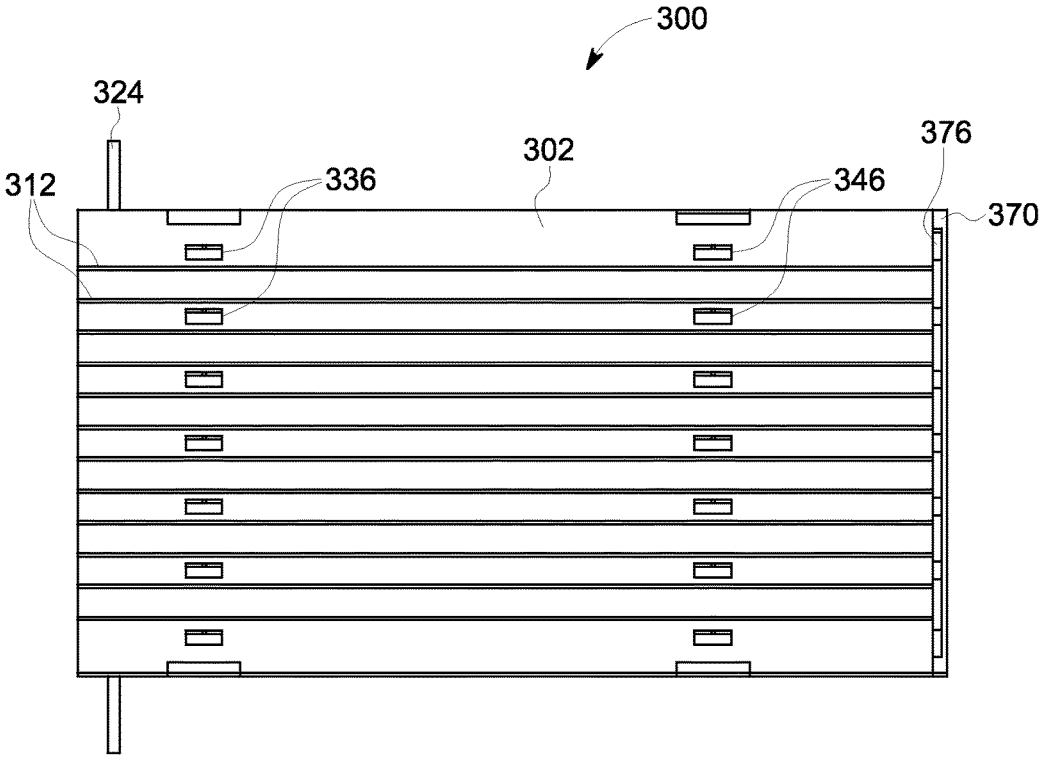
FIG. 7 is a schematic cross-sectional view of the fuel nozzle shown in FIG. 6.

FIG. 6 is an alternative perspective view of fuel nozzle 300 that may be used with combustor assembly 124, and FIG. 7 is a schematic cross-sectional view of fuel nozzle 300. In the exemplary embodiment, fuel nozzle 300 includes a heat shield 370 coupled thereto at downstream end 306 of fuel nozzle 300. Heat shield 370 is constructed from a heat resistant material and facilitates protecting fuel nozzle 300 from the high temperature combustion gases within combustion zone 234 (shown in FIG. 2). Heat shield 370 includes premixer tube openings 372 and cooling passage openings 374 defined therein. In the exemplary embodiment, premixer tube openings 372 are sized to enable premixer tubes 310 to be positioned therein such that heat shield 370 does not interrupt the flow communication between premixer tubes 310 and combustion zone 234.

As described above, cooling passages 312 are defined within and extend through nozzle body 302. In the exemplary embodiment, heat shield 370 and fuel nozzle 300 are configured to define a cooling plenum 376 therebetween when heat shield 370 is coupled to fuel nozzle 300. Accordingly, cooling passages 312 are configured to channel a flow of cooling air from air plenum 250 to cooling plenum 376 to facilitate cooling heat shield 370 during operation. In the exemplary embodiment, cooling passage openings 374 are defined along the periphery of heat shield 370. As such, cooling air is enabled to impinge against heat shield 370 before being discharged through cooling passage openings 374. Furthermore, positioning cooling passage openings 374 about the periphery of heat shield 370 facilitates discharging the cooling air proximate to combustor liner 252 (shown in FIG. 2).

The fuel nozzle described herein facilitates reducing NOx emissions of a turbine engine by pre-mixing fuel and air in premixer tubes such that combustion gas temperature is controlled. Moreover, the fuel nozzle enables the use of both liquid fuel and gas fuel therein for either dual fuel or duel fire operation. When configured to pre-mix liquid fuel, a liquid fuel injector discharges a flow of atomized liquid fuel therefrom. Accordingly, the use of water injection is substantially reduced thereby reducing the likelihood of impact on the downstream turbine components. As such, the fuel nozzle described herein facilitates mixing the fuel and air channeled therethrough such that a substantially uniform fuel-air mixture is discharged therefrom, facilitates reducing flashback, and facilitates increasing the turndown ratio of the combustor assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuel nozzle for use in a turbine engine comprising:

a nozzle body;

a liquid fuel injector configured to discharge liquid fuel therefrom; and a plurality of premixer tubes defined within and extending through said nozzle body, each of said plurality of premixer tubes coupled in flow communication with said liquid fuel injector and configured to receive a flow of liquid fuel and a flow of air at an upstream end of said plurality of premixer tubes, wherein the flow of liquid fuel and the flow of air in each premixer tube are progressively mixed as the flow of liquid fuel and the flow of air are channeled through each premixer tube, wherein said liquid fuel injector comprises a plurality of fuel spokes that each comprises a hollow tube that are straight and having a plurality of injection ports defined therein that are each configured to discharge liquid fuel therefrom, and each said injection port substantially coaxially aligns with a corresponding premixer tube centerline axis and is configured to direct a liquid fuel jet substantially axially into said corresponding premixer tube, wherein each liquid fuel jet comprises a discharge angle of 5° to 15° with respect to the corresponding premixer tube centerline axis, wherein said plurality of fuel spokes extend through said nozzle body and through said plurality of premixer tubes substantially perpendicularly with respect to the centerline axes of the plurality of premixer tubes.

2. The fuel nozzle in accordance with claim 1, wherein said fuel injector comprises:

a plurality of gas fuel passages extending through said nozzle body substantially perpendicularly with respect to said plurality of premixer tube; and a plurality of as fuel injection ports defined within said nozzle body and configured to couple said plurality of gas fuel passages in flow communication with said plurality of premixer tubes.

3. The fuel nozzle in accordance with claim 1 further comprising an air plenum positioned upstream from said plurality of premixer tubes.

4. The fuel nozzle in accordance with claim 3, wherein said air plenum is configured to direct the air flow substantially axially into each of said plurality of premixer tubes.

5. The fuel nozzle in accordance with claim 1 further comprising:

a heat shield coupled to a downstream end of said nozzle body; and a cooling passage extending through said nozzle body, said cooling passage configured to direct a second flow of air towards said heat shield to cool the heat shield.

* * * * *